US011598575B2

(12) United States Patent
Wu et al.

(10) Patent No.: US 11,598,575 B2
(45) Date of Patent: Mar. 7, 2023

(54) SIDE-OPEN LEFT-RIGHT-DOOR ARBITRARY-OPENING STRUCTURE OF REFRIGERATOR

(71) Applicants: SKYWORTH ELECTRIC CO., LTD., Nanjing (CN); Way Interglobal Network, LLC, Elkhart, IN (US)

(72) Inventors: Ping Wu, Nanjing (CN); Haichao Zhang, Nanjing (CN); Yanxi Chong, Nanjing (CN); Wenwen Nie, Nanjing (CN); Qinan Wu, Nanjing (CN); Gary Xie, Nanjing (CN)

(73) Assignees: SKYWORTH ELECTRIC CO., LTD., Nanjing (CN); Way Interglobal Network, LLC, Elkhart, IN (US)

( * ) Notice: Subject to any disclaimer, the term of this patent is extended or adjusted under 35 U.S.C. 154(b) by 0 days.

(21) Appl. No.: 17/648,104

(22) Filed: Jan. 14, 2022

(65) Prior Publication Data

US 2022/0136760 A1 May 5, 2022

(30) Foreign Application Priority Data

Dec. 20, 2021 (CN) ..... 202111561466.5

(51) Int. Cl.

| | |
|---|---|
| ***F25D 23/02*** | (2006.01) |
| ***E05D 15/50*** | (2006.01) |
| ***E05D 7/081*** | (2006.01) |

(52) U.S. Cl.

CPC ..... *F25D 23/028* (2013.01); *E05D 7/081* (2013.01); *E05D 15/505* (2013.01); (Continued)

(58) Field of Classification Search

CPC ..... F25D 2323/022; F25D 23/028; F25D 2323/024; E05Y 2900/31; E05Y 2201/218; E05Y 2201/418; E05Y 2201/474; E05Y 2800/174; E05D 7/02; E05D 15/505; E05D 15/502; E05D 15/50; E05D 7/123; E05D 2007/128; E05D 11/06; E05D 7/081;

(Continued)

(56) References Cited

U.S. PATENT DOCUMENTS 4,495,673 A * 1/1985 Khan ..... E05D 15/505 16/DIG. 23
4,503,582 A * 3/1985 Gurubatham ..... E05D 15/505 16/DIG. 23

(Continued)

*Primary Examiner* — Hiwot E Tefera
(74) *Attorney, Agent, or Firm* — CBM Patent Consulting, LLC

(57) ABSTRACT

A side-open left-right-door arbitrary-opening structure of a refrigerator comprises four hinge shafts are fixedly connected at left and right sides of a refrigerator body in pairs respectively, left and right sides of upper and lower end faces of a refrigerator door are all provided with an opening neck, each hinge shaft is correspondingly placed in one opening neck, four hinge shaft stoppers are slidably arranged on the upper and lower end faces of the refrigerator door in pairs respectively, one spring is arranged between two hinge shaft stoppers in each pair, tail ends of the hinge shaft stoppers on the upper and lower end faces of the refrigerator door extend into the opening necks at the corresponding sides, and the hinge shafts at the corresponding sides are positioned in the opening necks.

7 Claims, 4 Drawing Sheets

(52) U.S. Cl.
CPC ..... *E05Y 2900/31* (2013.01); *F25D 2323/022* (2013.01); *F25D 2323/024* (2013.01)

(58) Field of Classification Search
CPC . Y10T 16/553; Y10T 16/547; Y10T 16/5285; Y10S 16/23
See application file for complete search history.

(56) References Cited

U.S. PATENT DOCUMENTS

| | | | | | |
|---|---|---|---|---|---|
| 4,503,584 | A * | 3/1985 | Malchow | E05D 15/505 | 16/DIG. 23 |
| 5,222,792 | A * | 6/1993 | Kai | E05F 7/005 | 312/406 |
| 5,548,927 | A * | 8/1996 | Song | E05D 15/505 | 49/193 |
| 5,675,934 | A * | 10/1997 | Park | E05D 15/505 | 16/DIG. 23 |
| 6,000,771 | A * | 12/1999 | Wissinger | F25D 23/02 | 312/401 |
| 10,697,694 | B2 * | 6/2020 | Steiger | E05D 15/505 | |
| 2006/0196120 | A1 * | 9/2006 | Yamada | E05D 15/502 | 49/193 |
| 2007/0256447 | A1 * | 11/2007 | Leimkuehler | F25D 23/028 | 62/440 |
| 2008/0172838 | A1 * | 7/2008 | Choi | F25D 23/028 | 312/405 |
| 2015/0361704 | A1 * | 12/2015 | Larsen | E05F 1/10 | 49/386 |
| 2017/0107748 | A1 * | 4/2017 | Öhman | E05D 15/50 | |
| 2019/0178564 | A1 * | 6/2019 | Steiger | E05D 11/06 | |

* cited by examiner

SIDE-OPEN LEFT-RIGHT-DOOR ARBITRARY-OPENING STRUCTURE OF REFRIGERATOR

CROSS REFERENCES

This application claims priority to Chinese Patent Application Ser. No. 2021115614665 filed 20 Dec. 2021.

TECHNICAL FIELD

The present invention relates to a side-open left-right-door arbitrary-opening structure of a refrigerator.

BACKGROUND

In modern urban life, a housing space is small, especially in a kitchen, or a recreational vehicle and the like, there is a small space, and when a refrigerator has only one door opening direction, it is often inconvenient in use, and people must stand at a fixed door opening place to take articles in the refrigerator.

SUMMARY

The present invention provides a side-open left-right-door arbitrary-opening structure of a refrigerator to solve the above problem in the prior art.

The technical solutions used in the present invention are as follows.

A side-open left-right-door arbitrary-opening structure of a refrigerator comprises a refrigerator body and a refrigerator door, and further comprises handle frame bars, hinge shafts, hinge shaft stoppers, springs and transmission bodies, wherein four hinge shafts are fixedly connected at left and right sides of the refrigerator body in pairs respectively, left and right sides of upper and lower end faces of the refrigerator door are all provided with an opening neck, each hinge shaft is correspondingly placed in one opening neck, four hinge shaft stoppers are slidably arranged on the upper and lower end faces of the refrigerator door in pairs respectively, one spring is arranged between two hinge shaft stoppers in each pair, tail ends of the hinge shaft stoppers on the upper and lower end faces of the refrigerator door extend into the opening necks at the corresponding sides, and the hinge shafts at the corresponding sides are positioned in the opening necks, so that the refrigerator door is closed on the refrigerator body; and two handle frame bars are rotatably connected onto left and right end faces of the refrigerator door respectively, the handle frame bar at each side is linked with two hinge shaft stoppers at the corresponding sides of the upper and lower end faces of the refrigerator door through two transmission bodies, the handle frame bar at the left or right side is pulled, and the pulled handle frame bar simultaneously drives two hinge shaft stoppers at the corresponding sides of the upper and lower end faces of the refrigerator door to slide and separate from the corresponding opening necks through two transmission bodies, thus opening the refrigerator door.

Further, the transmission body comprises a second rotating shaft, a rotating shaft connector, a first positioning shaft and a second positioning shaft, the first positioning shaft is fixedly connected onto the refrigerator door, the second positioning shaft is fixedly connected onto the hinge shaft stopper, the rotating shaft connector is sleeved on the first positioning shaft, two ends of the rotating shaft connector are provided with a round hole and a waist-shaped hole, the round hole of the rotating shaft connector is sleeved on the second rotating shaft, and the waist-shaped hole is sleeved on the second positioning shaft.

Further, the refrigerator door is provided with a waist-shaped hole, the second rotating shaft is inserted into the waist-shaped hole of the refrigerator door, and a bottom end of the second rotating shaft extends into the handle frame bar.

Further, a first rotating shaft is fixed on the handle frame bar, and the handle frame bar is rotatably connected onto the refrigerator door through the first rotating shaft.

Further, an upper end face of the handle frame bar is provided with a waist-shaped hole, and a bottom end of the second rotating shaft extends into the waist-shaped hole of the handle frame bar.

Further, an inside end face of the hinge shaft stopper is provided with a round hole, and the spring is placed in the round hole of the hinge shaft stopper.

Further, an outer wall at an outside end of the hinge shaft stopper is provided with a limiting boss, and after an outside tail end of the hinge shaft stopper extends into the opening neck at the corresponding side, the limiting boss abuts against an outer wall of the opening neck.

The refrigerator door can be opened at two sides of the refrigerator, so that articles can be taken conveniently, resulting in the following beneficial effects:

1) a user may open the refrigerator door at any side of the refrigerator to take articles;
2) a maximum stroke of the hinge shaft stopper can only meet a requirement that the hinge shaft may just be released, an assembly place between the hinge shaft stopper and the spring is provided with a positioning design (which is namely the limiting boss), and when two sides are positioned and contacted, the springs are no longer compressed, which may ensure that when the handles at the two sides are pulled at the same time, the refrigerator door will not fall off due to release of all hinge shafts at the two sides;
3) at the two sides of the refrigerator door designed with the handles, front faces are kept complete in appearance; and
4) two sides of the hinge shaft stopper should be designed with ribs for guiding, so that only horizontal displacement occurs in the case of stressing.

Figure 1:
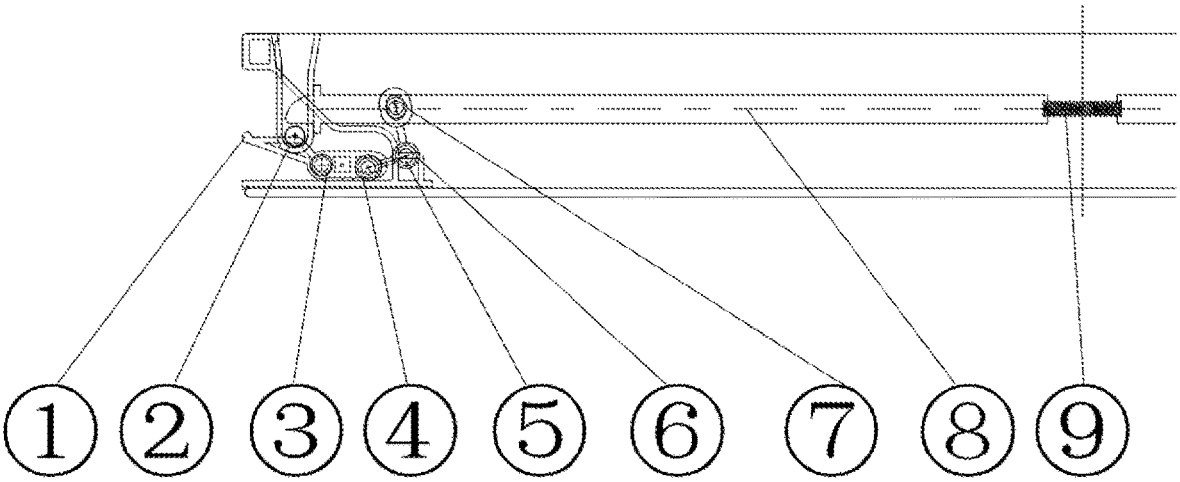
FIG. 1 is a schematic mechanical structure diagram of a door opening structure of the present invention.

In the drawings: 1 refers to handle frame bar; 2 refers to hinge shaft; 3 refers to first rotating shaft; 4 refers to second rotating shaft; 5 refers to rotating shaft connector; 6 refers to first positioning shaft; 7 refers to second positioning shaft; 8 refers to hinge shaft stopper; and 9 refers to spring.

DETAILED DESCRIPTION

The present invention is further described hereinafter with reference to the accompanying drawings.

Figure 2:
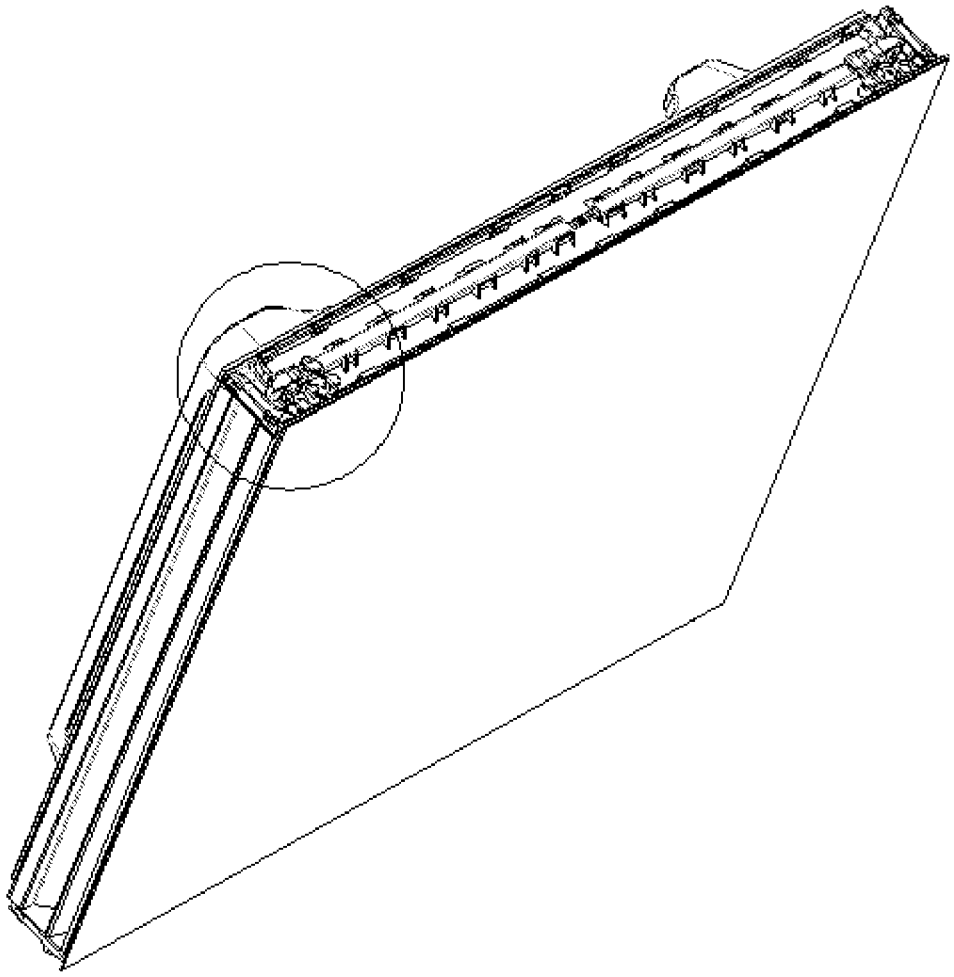
FIG. 2 is a schematic three-dimensional appearance diagram of the door opening structure on a refrigerator door.
Figure 3:
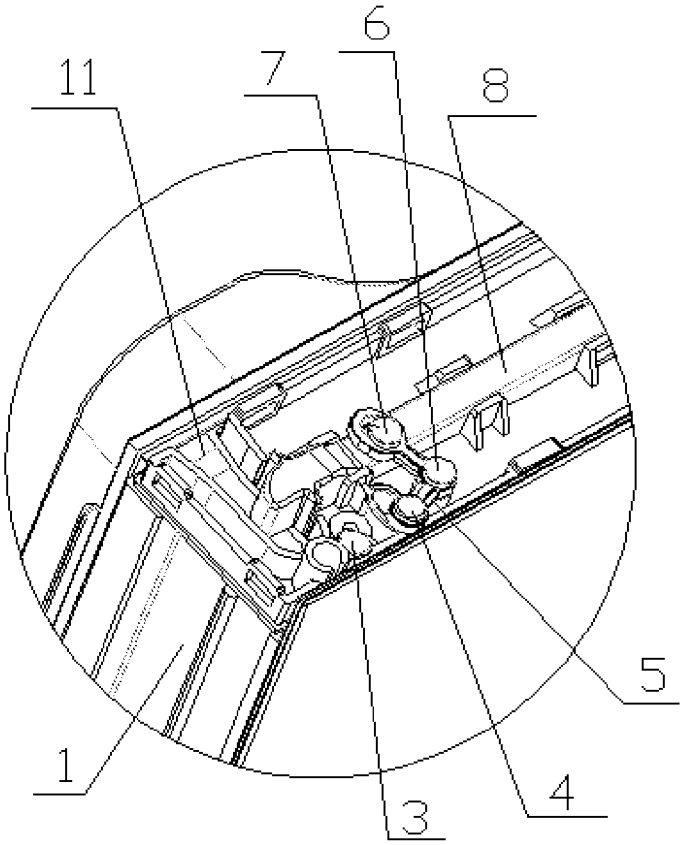
FIG. 3 is a mounting structure diagram of the door opening structure on the refrigerator door.
Figure 4:
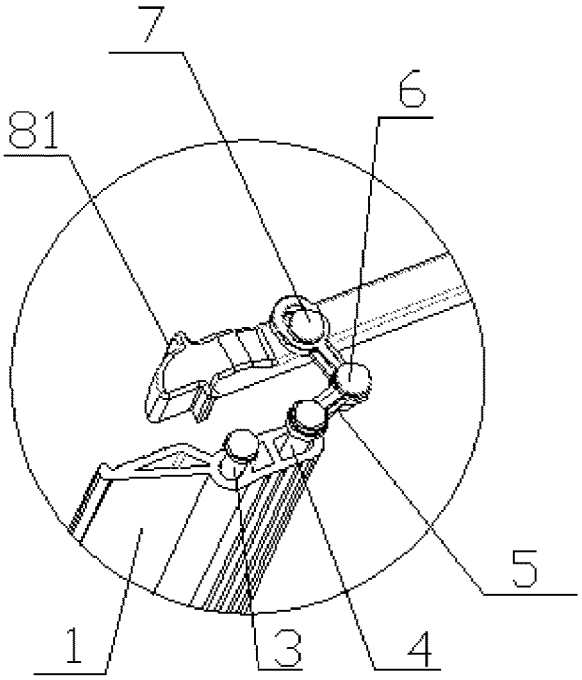
FIG. 4 is a structure diagram of a transmission body.
Figure 5:
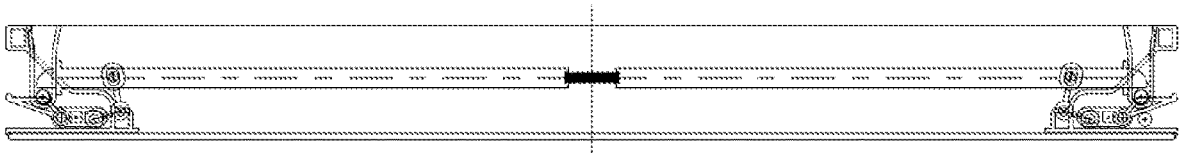
FIG. 5 is a schematic two-dimensional diagram of the present invention in a state that the refrigerator door is closed.
Figure 6:
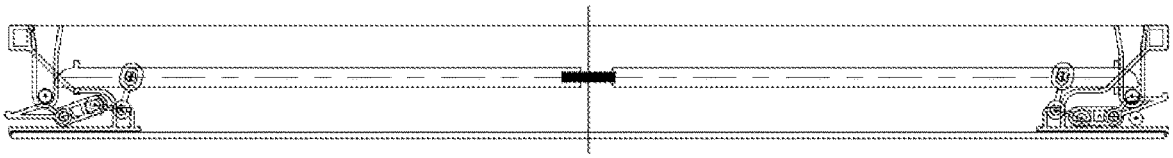
FIG. 6 is a schematic two-dimensional diagram of internal details of the present invention.

As shown in FIG. 1 to FIG. 4, a side-open left-right-door arbitrary-opening structure of a refrigerator of the present invention comprises a refrigerator body and a refrigerator door, and handle frame bars 1, hinge shafts 2, hinge shaft stoppers 8, springs 9 and transmission bodies. Four hinge shafts 2 are fixedly connected at left and right sides of the refrigerator body in pairs respectively, left and right sides of upper and lower end faces of the refrigerator door are all provided with an opening neck 11, and each hinge shaft 2 is correspondingly placed in one opening neck 11. Four hinge shaft stoppers 8 are slidably arranged on the upper and lower end faces of the refrigerator door in pairs respectively, one spring 9 is arranged between two hinge shaft stoppers 8 in each pair, tail ends of the hinge shaft stoppers 8 on the upper and lower end faces of the refrigerator door extend into the opening necks 11 at the corresponding sides, and the hinge shafts 2 at the corresponding sides are positioned in the opening necks 11, so that the refrigerator door is closed on the refrigerator body.

Two handle frame bars 1 are rotatably connected onto left and right end faces of the refrigerator door respectively, the handle frame bar 1 at each side is linked with two hinge shaft stoppers 8 at the corresponding sides of the upper and lower end faces of the refrigerator door through two transmission bodies, the handle frame bar 1 at the left or right side is pulled, and the pulled handle frame bar 1 simultaneously drives two hinge shaft stoppers 8 at the corresponding sides of the upper and lower end faces of the refrigerator door to slide and separate from the corresponding opening necks 11 through two transmission bodies, thus opening the refrigerator door at the moment.

The transmission body in the present invention comprises a second rotating shaft 4, a rotating shaft connector 5, a first positioning shaft 6 and a second positioning shaft 7. The first positioning shaft 6 is fixedly connected onto the refrigerator door, the second positioning shaft 7 is fixedly connected onto the hinge shaft stopper 8, the rotating shaft connector 5 is sleeved on the first positioning shaft 6, and two ends of the rotating shaft connector 5 are provided with a round hole and a waist-shaped hole. The round hole of the rotating shaft connector 5 is sleeved on the second rotating shaft 4, and the waist-shaped hole is sleeved on the second positioning shaft 7.

The refrigerator door is provided with a waist-shaped hole, the second rotating shaft 4 is inserted into the waist-shaped hole of the refrigerator door, and a bottom end of the second rotating shaft 4 extends into the handle frame bar 1. An upper end face of the handle frame bar 1 is provided with a waist-shaped hole, and a bottom end of the second rotating shaft 4 extends into the waist-shaped hole of the handle frame bar 1.

In order to facilitate rotatable connection of the handle frame bar on the refrigerator door, a first rotating shaft 3 is fixed on the handle frame bar 1, and the handle frame bar 1 is rotatably connected onto the refrigerator door through the first rotating shaft 3.

In order to better position and mount the spring, an inside end face of the hinge shaft stopper 8 is provided with a round hole, and the spring 9 is placed in the round hole of the hinge shaft stopper 8.

In order to facilitate limitation of the position of the hinge shaft stopper 8 inserted into the opening neck, an outer wall at an outside end of the hinge shaft stopper 8 is provided with a limiting boss 81, and after an outside tail end of the hinge shaft stopper 8 extends into the opening neck 11 at the corresponding side, the limiting boss 81 abuts against an outer wall of the opening neck 11.

Two sides of the hinge shaft stopper should be designed with ribs for guiding to ensure more stable sliding of the hinge shaft stopper 8.

The present invention is specifically used as follows.

In a state that the refrigerator door is closed:

The hinge shafts 2 at two sides are all fixed at designed positions by the hinge shaft stoppers 8, and the refrigerator door is adsorbed on a front face of the refrigerator body through magnetic strips, thus keeping a stable state.

When the refrigerator door needs to be opened at one side:

in first step: a user presses the handle frame bar 1, and the handle frame bar rotates around the first rotating shaft 3, thus driving the second rotating shafts 4 to synchronously rotate around the first rotating shaft 3;

in second step: the rotation of the second rotating shafts 4 drives the rotating shaft connectors 5 to rotate around the first positioning shafts 6;

in third step: the other ends of the rotating shaft connectors 5 are connected with the hinge shaft stoppers 8 through the second positioning shafts 7, so that when the rotating shaft connectors 5 rotate around the first positioning shafts 6, the second positioning shafts 7 simultaneously drive the hinge shaft stoppers 8 to slide to the right in a set horizontal direction, and the spring 9 is compressed; and in fourth step: the hinge shaft stoppers 8 slide to the right, the hinge shafts 2 are released, and at the moment, the refrigerator door rotates around the hinge shafts at the other side, so that the refrigerator door is normally opened to take articles.

3. When the user closes the refrigerator door:

the hinge shafts 2 enter from the opening necks, the hinge shaft stoppers 8 are pressed to the right through guide faces of the hinge shaft stoppers 8, the stoppers slide horizontally to the right along a set direction at the moment, the spring 9 is compressed, when the hinge shafts 2 completely pass through the hinge shaft stoppers 8, the spring 9 is elastically recovered, and the hinge shaft stoppers are pressed back to initial positions to ensure a stability of the refrigerator door.

The description above is merely the preferred embodiments of the present invention, and it should be pointed out that those of ordinary skills in the art may further make several improvements without departing from the principle of the present invention, and these improvements should also be regarded as falling within the scope of protection of the present invention.

What is claimed is:

1. A side-open left-right-door arbitrary-opening structure of a refrigerator, comprising a refrigerator body and a refrigerator door, and further comprising handle frame bars (1), hinge shafts (2), hinge shaft stoppers (8), springs (9) and transmission bodies, wherein four hinge shafts (2) are fixedly connected at left and right sides of the refrigerator body in pairs respectively, left and right sides of upper and lower end faces of the refrigerator door are all provided with an opening neck (11), each hinge shaft (2) is correspondingly placed in one opening neck (11), four hinge shaft stoppers (8) are slidably arranged on the upper and lower end faces of the refrigerator door in pairs respectively, one spring (9) is arranged between two hinge shaft stoppers (8) in each pair, tail ends of the hinge shaft stoppers (8) on the upper and lower end faces of the refrigerator door extend into the opening necks (11) at the corresponding sides, and the hinge shafts (2) at the corresponding sides are positioned in the opening necks (11), so that the refrigerator door is closed on the refrigerator body; and two handle frame bars (1) are rotatably connected onto left and right end faces of the refrigerator door respectively, the handle frame bar (1) at each side is linked with two hinge shaft stoppers (8) at the corresponding sides of the upper and lower end faces of the refrigerator door through two transmission bodies, the handle frame bar (1) at the left or right side is pulled, and the pulled handle frame bar (1) simultaneously drives two hinge shaft stoppers (8) at the corresponding sides of the upper and lower end faces of the refrigerator door to slide and separate from the corresponding opening necks (11) through two transmission bodies, thus opening the refrigerator door; wherein each of the two transmission bodies comprises a second rotating shaft (4), a rotating shaft connector (5), a first positioning shaft (6) and a second positioning shaft (7).

2. The side-open left-right-door arbitrary-opening structure according to claim 1, wherein the first positioning shaft (6) is fixedly connected onto the refrigerator door, the second positioning shaft (7) is fixedly connected onto the hinge shaft stopper (8), the rotating shaft connector (5) is sleeved on the first positioning shaft (6), two ends of the rotating shaft connector (5) are provided with a round hole and a waist-shaped hole, the round hole of the rotating shaft connector (5) is sleeved on the second rotating shaft (4), and the waist-shaped hole is sleeved on the second positioning shaft (7).

3. The side-open left-right-door arbitrary-opening structure according to claim 2, wherein the refrigerator door is provided with a waist-shaped hole, the second rotating shaft (4) is inserted into the waist-shaped hole of the refrigerator door, and a bottom end of the second rotating shaft (4) extends into the handle frame bar (1).

4. The side-open left-right-door arbitrary-opening structure according to claim 2, wherein a first rotating shaft (3) is fixed on the handle frame bar (1), and the handle frame bar (1) is rotatably connected onto the refrigerator door through the first rotating shaft (3).

5. The side-open left-right-door arbitrary-opening structure according to claim 2, wherein an upper end face of the handle frame bar (1) is provided with a waist-shaped hole, and a bottom end of the second rotating shaft (4) extends into the waist-shaped hole of the handle frame bar (1).

6. The side-open left-right-door arbitrary-opening structure according to claim 1, wherein an inside end face of the hinge shaft stopper (8) is provided with a round hole, and the spring (9) is placed in the round hole of the hinge shaft stopper (8).

7. The side-open left-right-door arbitrary-opening structure according to claim 1, wherein an outer wall at an outside end of the hinge shaft stopper (8) is provided with a limiting boss (81), and after an outside tail end of the hinge shaft stopper (8) extends into the opening neck (11) at the corresponding side, the limiting boss (81) abuts against an outer wall of the opening neck (11).

* * * * *